US006725888B1

(12) United States Patent
Richter et al.

(10) Patent No.: US 6,725,888 B1
(45) Date of Patent: Apr. 27, 2004

(54) METHOD OF ACCURATELY FILLING AND DEGASSING A POUCH

(75) Inventors: Edward B. Richter, Rochester, NY (US); L. Ronald Whitlock, Pittsford, NY (US); Diana C. Petranek, Hilton, NY (US); Gary E. Merz, Rochester, NY (US); John C. Green, Canandaigua, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/321,244

(22) Filed: Dec. 17, 2002

(65) Prior Publication Data

(65)

(51) Int. Cl.[7] ..... B65B 1/04

(52) U.S. Cl. ..... 141/83; 141/114; 347/85

(58) Field of Search ..... 141/83, 10, 313–317, 141/114, 2, 18, 67; 347/84–87

(56) References Cited

U.S. PATENT DOCUMENTS 4,096,859 A 6/1978 Agarwal et al.
4,156,244 A 5/1979 Erikson et al.
4,253,103 A 2/1981 Heinzl et al.
4,446,674 A 5/1984 Inada
4,630,654 A 12/1986 Kennedy, Jr.
4,703,780 A 11/1987 Reeves, Jr. et al.
5,067,532 A 11/1991 Lang et al.
5,322,095 A * 6/1994 Bolz ..... 141/83
5,431,201 A * 7/1995 Torchia et al. ..... 141/98
5,477,896 A * 12/1995 Grifols Lucas ..... 141/83
5,704,403 A 1/1998 Schwenk et al.
5,929,883 A * 7/1999 Gunther et al. ..... 347/85
5,971,533 A 10/1999 Kinoshita et al.
6,120,138 A * 9/2000 Xiao et al. ..... 347/85
6,158,851 A 12/2000 Zepeda
6,257,714 B1 7/2001 Seccombe
6,539,985 B2 * 4/2003 Shinada et al. ..... 141/2

* cited by examiner

*Primary Examiner*—Steven O. Douglas
(74) *Attorney, Agent, or Firm*—Clyde E. Bailey, Sr.

(57) ABSTRACT

A method for filling and degassing a pouch contained in a cartridge. A fluid injection unit introduces fluid into a rotatable pouch. The pouch contained in the cartridge is permitted to rotate from a vertical position for degassing and weighing to a horizontal position for fluid introduction. After several rotational cycles, accurate pouch weighing and complete evacuation of the pouch results in a precise fluid loaded pouch.

5 Claims, 4 Drawing Sheets

METHOD OF ACCURATELY FILLING AND DEGASSING A POUCH

CROSS-REFERENCE TO RELATED APPLICATIONS

The present application is related to U.S. application Ser. No. 10/321,254, filed Dec. 17, 2002, by Edward B. Richter, et al., and titled, "Apparatus For Filling And Degassing A Pouch."

FIELD OF THE INVENTION

The invention relates generally to the field of fluid filling. More particularly, the invention concerns an apparatus and method for filling a pouch with a fluid material in a manner that the pouch is degassed and receives a precise amount of the fluid material during the filling process.

BACKGROUND OF THE INVENTION

Commercial cartridges containing a pouch for receiving a fluid material, such as large ink jet cartridges (1000 ml or greater), are required for commercial, wide format ink jet printers. Typically, these cartridges consist of two-molded plastic cartridge halves generally ultrasonically sealed together. The cartridge also contains a pouch to be filled arranged in the interior portion of the cartridge. An opening is generally provided in a portion of the cartridge to provide access to the pouch as well as to means of inserting and removing the pouch from the cartridge. Further, a septum for filling the pouch is typically arranged in the top portion of the pouch. This septum is similar to devices used on pharmaceutical vials. Filling the pouch with a fluid material, such as ink, is generally undertaken after the cartridge has been assembled, by inserting a needle through the septum and pumping ink through the needle. Heretofore, it has generally been problematic to deliver a precise weight of fluid material into the pouch.

Another problem with current fluid filling developments is that the pouch or container being filled generally will contain a fair amount of residual gasses that negatively influence the outcome of the filling process. Those skilled in the art will appreciate that some printers, like ink jet printers having an electric print head rather than a thermal print head such as found in most desktop ink jet printers, require a more precise pouch loading precondition. Because of this, all gases must be evacuated from the pouch to be filled. An acceptable level of oxygen remaining in the cartridge is less than 1 part per million.

Therefore, there persists a need in the art for an apparatus and method for accurately and precisely filling and degassing a sealed pouch contained in a cartridge that is cost effective to manufacture, simple to use, and is reliable.

SUMMARY OF THE INVENTION

The present invention is directed to overcoming one or more of the problems set forth above Briefly summarized, according to one aspect of the present invention, a method of filling and degassing a pouch contained in a cartridge comprises providing a cartridge containing a pouch to be filled and degassed. A fluid injection unit is provided having a fluid injection member, a support member for holding said cartridge, means for determining the weight of pouch. Means is provided for pivoting cartridge from a substantially horizontal position to a substantially vertical position to effectuate loading and degassing. After degassing the pouch, the cartridge is mounted onto the support member of the fluid injection unit in a substantially horizontal position so that fluid injection member is alignably inserted into the pouch to be filled. The cartridge is pivoted from a substantially horizontal position to a substantially vertical position thereby repositioning the pouch in a substantially vertical position. The weight of the cartridge and pouch is determined in the vertical position prior to injecting fluid into the pouch. Once the cartridge and pouch are weighed, the cartridge is rotated from the substantially vertical position to the substantially horizontal position thereby repositioning the pouch in a substantially horizontal position for liquid injection. The fluid is then introduced into the pouch to a level that exceeds a predetermined level forming an at least partially filled pouch. Again the cartridge containing a partially filled pouch is rotated from the substantially horizontal position to the substantially vertical position. The weight of the at least partially filled pouch is then determined. Any excess fluid and entrapped air is then evacuated from the partially filled pouch. Finally, the cartridge containing the precisely loaded pouch is then rotated from the substantially vertical position to the substantially horizontal position for removal from the fixture.

The present invention has numerous advantages over prior developments. In particular, the present invention provides for removal of all entrapped air from the pouch to be filled, preventing degradation of the ink. Further, the present invention provides very accurate filling of the pouch to be filled. Moreover, handling of the cartridge/pouch is minimized using the present invention. Once the cartridge/pouch is inserted into the fixture, the entire filling/degassing operation takes place automatically. This also minimizes the number of times the septum is pierced during the manufacturing process. Still further, the throughput of the filling/degassing operation of the present invention is maximized. Also, the design of the mechanism is such that multiple cartridge/pouches can be filled/degassed simultaneously. Finally, the process can be applied to any product where accurate filling of a pouch with a liquid and removal of the air is required.

BRIEF DESCRIPTION OF THE DRAWINGS

The above and other objects, features, and advantages of the present invention will become more apparent when taken in conjunction with the following description and drawings, wherein identical reference numerals have been used, where possible, to designate identical features that are common to the figures, and wherein.

DETAILED DESCRIPTION OF THE INVENTION

Figure 1:
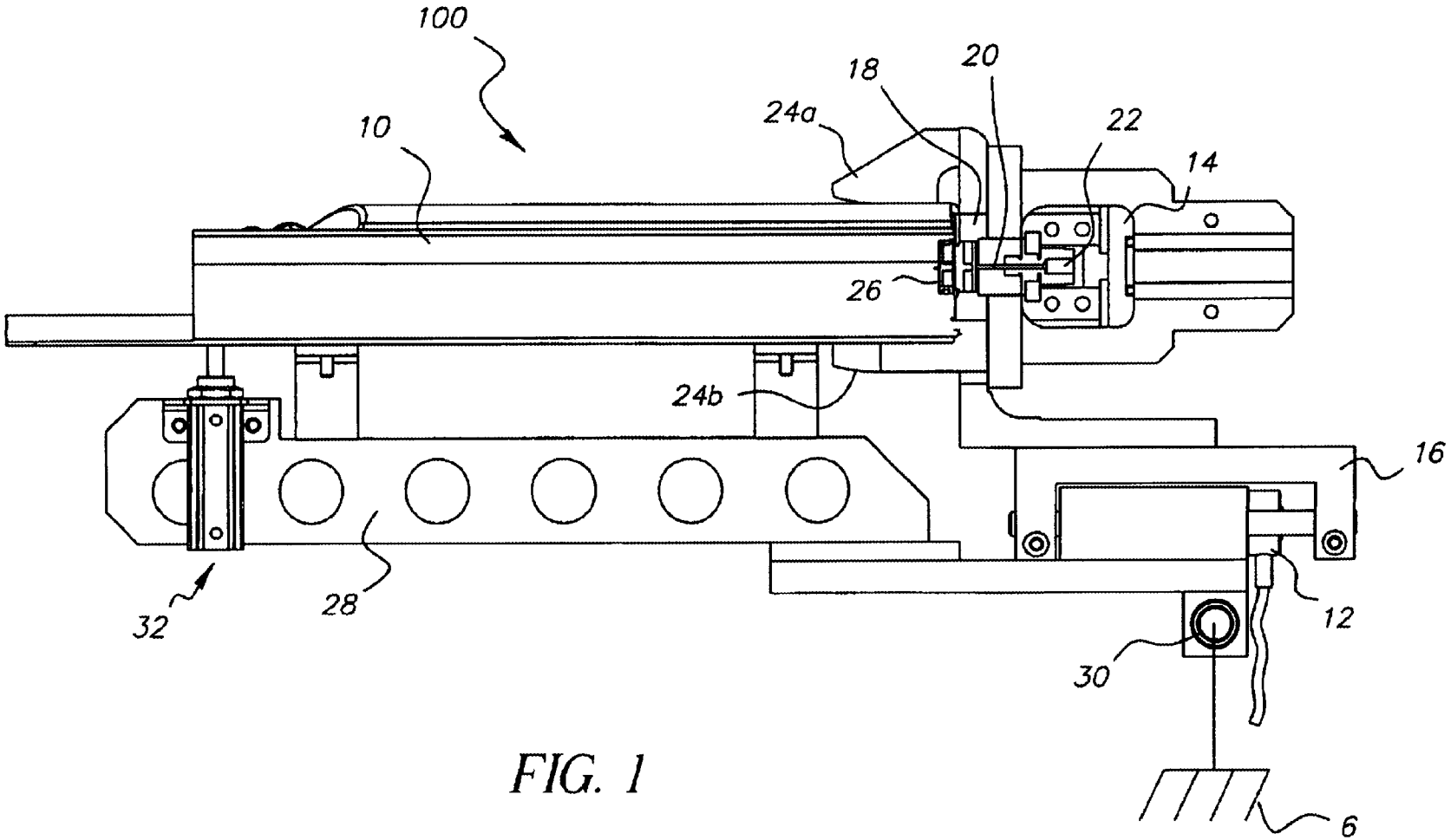
FIG. 1 is an elevated side view of the filling and weighing station of the invention.
Figure 2:
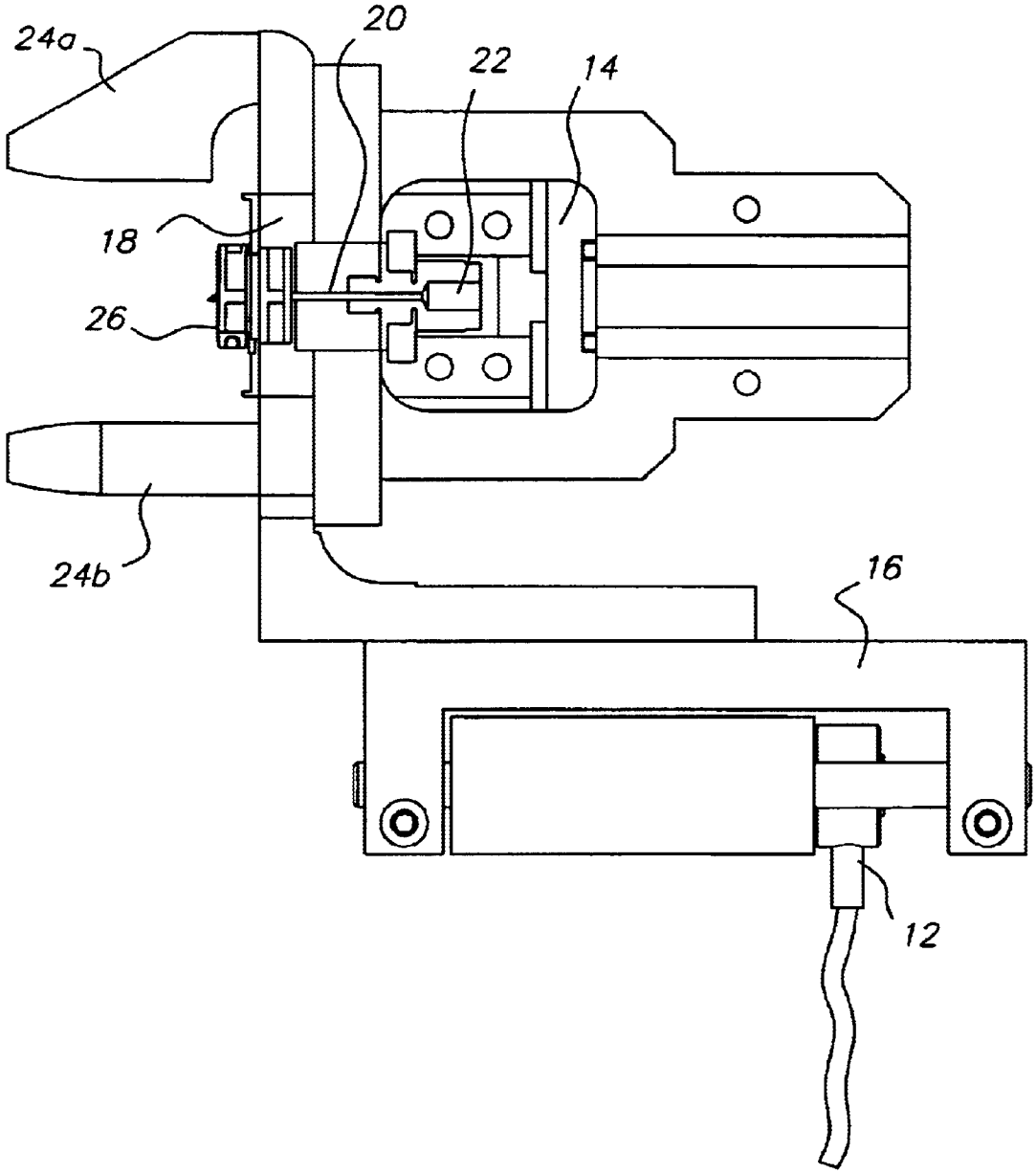
FIG. 2 is an enlarged elevated side view of the filling and weighing mechanism of the invention.

Turning now to the drawings, and in particular to FIGS. 1 and 2, an apparatus 100 used with the method of the invention for filling a pouch is illustrated. According to FIGS. 1 and 2, apparatus 100 for loading a pouch 8 (FIG. 3), to be filled with a fluid, contained in a cartridge 10, has a holding member 18 pivotably mounted at pivot point 30 to a rigid frame 6 for holding the cartridge 10. Holding member 18 includes a plurality of spaced alignment members 24*a*, 24*b* that constrain cartridge 10 in a fixed orientation. Preferably, there are at least three spaced alignment members for precise constraint, although only two can be seen in the Figures. As shown in FIG. 2, fluid injection member, or needle 20, is arranged preferably in a central portion of the support member 22. According to FIG. 3, for fluid loading, needle 20 is urged into the septum, or fluid inlet end 26, of the pouch 8.

Accurate weighing of the pouch 8 is achieved using an electronic weighing element, preferably a load cell 12, although a suitable analog weighing element can be used. In our invention (see FIGS. 1 and 2), load cell 12 is structurally associated with a slide assembly 16 connected to the frame 6 through fixture pivot point 30 for determining the weight of the cartridge 10. Fixture pivot 30 provides the preferred means for pivoting the cartridge 10 relative to the frame 6 between a substantially horizontal position to a substantially vertical position.

As indicated above, the printer (not shown) that uses the cartridge 10 of the invention employs piezo electric print heads rather than the thermal print heads found in most desktop ink jet printers. Because of the characteristics of the piezo electric print head, all air must be evacuated from the pouch to be filled. An acceptable level of oxygen remaining in the cartridge is less than 1 part per million. To accomplish this, the process detailed below has been developed.

It is important to the invention that the filling process is undertaken when the cartridge 10 is in a substantially horizontal position. Skilled artisans will appreciate that a horizontal filling position minimizes foaming of the fluid, for instance ink, during the pumping operation. The cartridge 10, containing pouch 8, is first mounted into a fixture 28 supported by frame 6. Cartridge 10 engages spaced alignment members 24*a*, 24*b* structurally associated with fixture 28. This engagement of cartridge 10 with spaced alignment members 24*a*, 24*b* enables the septum 26 of pouch 8 contained in the cartridge 10 to align with fluid injection member or needle 20. The needle 20 is, in turn, connected to a pumping system 46 having ink shut off valve 42 that pumps a fluid from reservoir 34 into the pouch 8.

Figure 3:
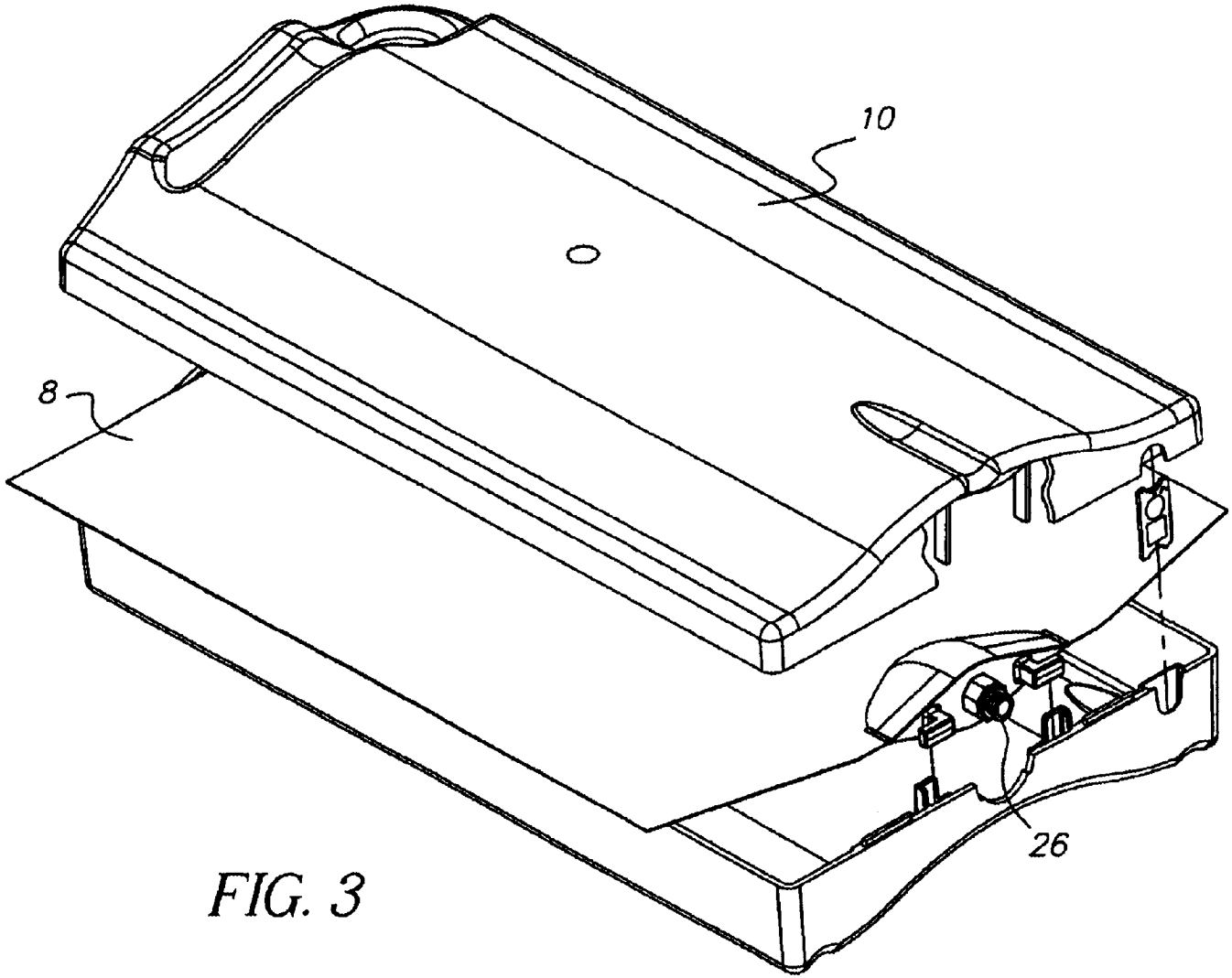
FIG. 3 is a partially exploded perspective view of a cartridge used in the invention; and, FIG. 4 is a schematic of the overall ink/air evacuation system of the invention.
Figure 4:
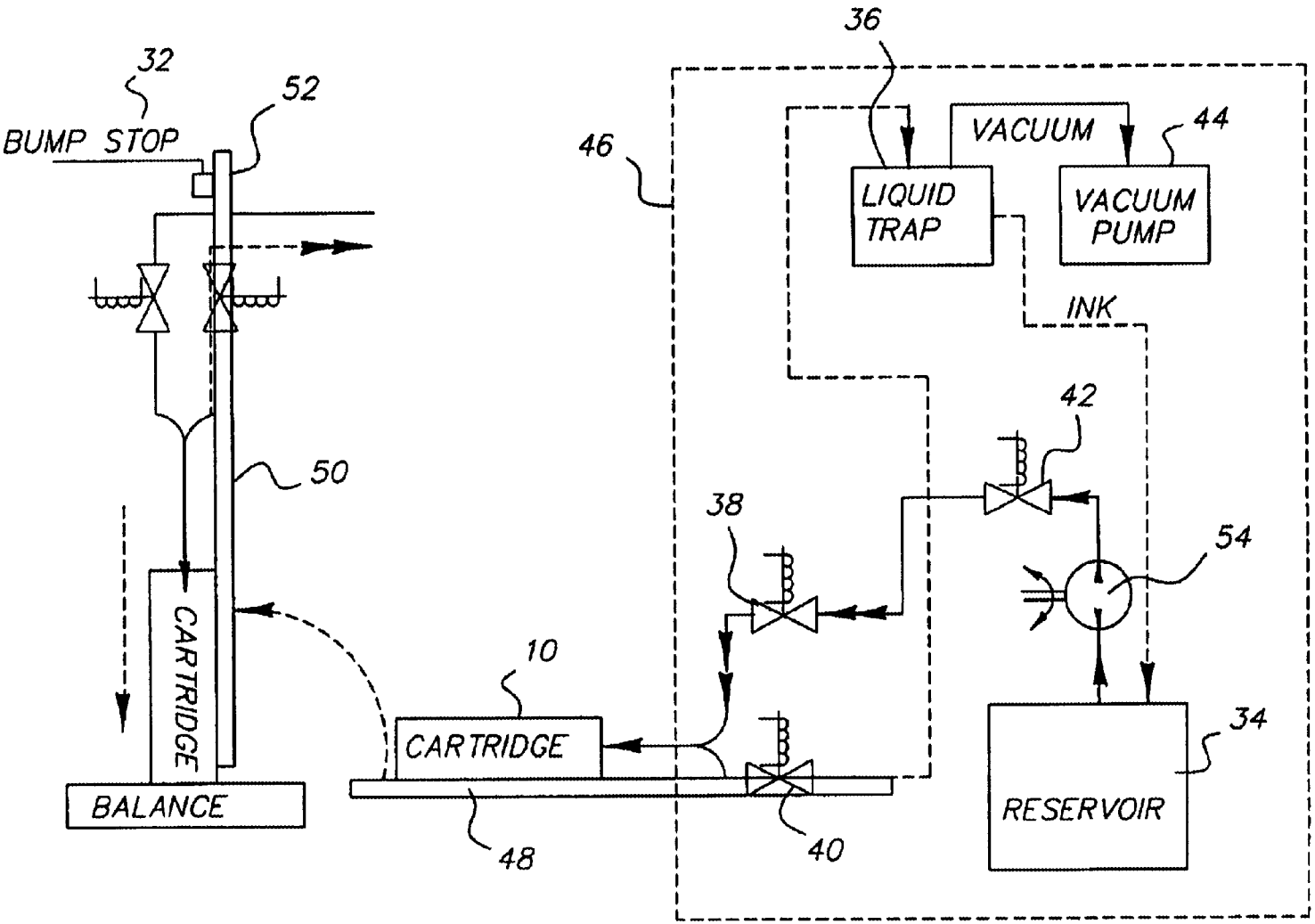

Referring to FIGS. 3 and 4, the pouch 8 contained in cartridge 10 in the substantially horizontal position is initially overfilled with the fluid by approximately 50 ml. The volume of fluid or ink, pumped into the pouch 8 to be filled is controlled by a pump 54, supplied by reservoir 34.

Referring to FIGS. 1 and 4, the fixture 28 that supports the cartridge 10 is then rotated through a pivot point 30 from a substantially horizontal position 48 to a substantially vertical position 50. Rotation of cartridge 10 can be accomplished by any means including manually or automatically by means of a drive motor. This rotation of cartridge 10 causes the entrapped residual gases, e.g. air, to rise to the top of the pouch 8 to be filled. At the terminus point 52 of the rotation, a fixed bump stop 32 in the path of rotation provides an elastic impact force to the cartridge 10. Bump stop 32, positioned at the end of the vertical rotation of fixture 28, facilitates the rise of air bubbles to the top of the pouch 8 to be filled.

Referring to FIG. 4, the preferred method of the invention for filling a pouch 8 with a fluid material, such as ink or a dye, includes the step of first evacuating the pouch 8 prior to associating the cartridge 10 with the ink toggle return valve 40. Ink/air is removed from the pouch 8 to be filled by a vacuum pump 44. The ink is separated from the air by a liquid trap 36 and returned to the reservoir 34.

According to FIG. 4, to obtain a very accurately filled cartridge (+/−1 ml), preferably a load cell 12 is incorporated into the mechanism that supports the cartridge 10. Load cell 12 continuously monitors the weight of the cartridge 10, ink and gripper mechanism 14 (shown in FIGS. 1 and 2). The output of load cell 12 is monitored by a control system (not shown), which is calibrated to calculate when a predetermined fill volume (in ml) is reached. The control system then stops the air/ink evacuation (degassing) process by deactivating ink toggle supply valve 38 and activating ink toggle return value 40 when a preset weight has been reached. Accuracy of the filling/degassing process is limited by the accuracy of load cell 12 that is used to measure weight of the cartridge 10.

Referring again to FIG. 4, after an accurate weight of cartridge 10 is determined, the cartridge 10 is then rotated about pivot point 30 from the vertical position 50 to the horizontal position 48. When the cartridge 10 is in the horizontal position 48, additional ink is pumped into the pouch 8 via ink reservoir 34 by activating ink toggle supply valve 38 and deactivating ink toggle return value 40.

Referring still again to FIG. 4, after fluid has been introduced into pouch 8, the cartridge 10 is then rotated about pivot 30 from the horizontal position 48 to the vertical position 50. At this stage, a second evacuation step of pouch 8 takes place. It is our experience that this repeat of the fill and the air/evacuation processes is important to the invention because it improves the accuracy of cartridge filling and degassing.

At the conclusion of the final pouch evacuation, the cartridge 10 is again rotated in fixture 28 about pivot 30 from the vertical position 50 to the horizontal position 48. The full pouch 8 contained in cartridge 10 is manually removed from fixture 28 and replaced by a fresh cartridge. The fresh cartridge is then filled and degassed using the same procedure described above.

The invention has been described with reference to a preferred embodiment. However, it will be appreciated that variations and modifications can be effected by a person of ordinary skill in the art without departing from the scope of the invention.

PARTS LIST

6 rigid frame
8 pouch
10 cartridge
12 load cell
14 gripper
16 slide assembly
18 holding member
20 needle
22 support member
24*a* spaced alignment member
24*b* spaced alignment member
26 septum, or fluid inlet end
28 fixture
30 fixture pivot point
32 bump stop
34 reservoir
36 liquid trap
38 ink toggle supply valve
40 ink toggle return valve
42 ink shut off valve
44 vacuum pump
46 pumping system
48 substantially horizontal position

50 substantially vertical position
52 terminus point of vertical rotation of cartridge 10
54 ink supply pump
100 apparatus

What is claimed is:

1. Method of filling and degassing a pouch contained in a cartridge, comprising the steps of:

(a) providing a cartridge containing a pouch to be filled and degassed;

(b) providing a fluid injection unit having a fluid injection member, a support member for holding said cartridge, means for determining said weight of said pouch to be filled, and means for pivoting said cartridge from a substantially horizontal position to a substantially vertical position;

(c) mounting said cartridge containing said pouch to be filled onto said support member of said fluid injection unit in a substantially horizontal position so that fluid injection member is inserted into said pouch to be filled;

(d) pivoting said cartridge from said substantially horizontal position to said substantially vertical position thereby repositioning said pouch to be filled in a substantially vertical position;

(e) determining the weight of said pouch to be filled prior to injection of a fluid;

(f) pivoting said cartridge to be filled from said substantially vertical position to said substantially horizontal position thereby repositioning said pouch to be filled in a substantially horizontal position;

(g) introducing said fluid into said pouch to be filled to a level that exceeds a predetermined level forming an at least partially filled pouch;

(h) pivoting said cartridge containing said at least a partially filled pouch from said substantially horizontal position to said substantially vertical position;

(i) determining the weight of said at least partially filled pouch containing said fluid;

(j) evacuating excess fluid and entrapped air contained in said at least partially filled pouch; and, (k) pivoting said cartridge containing said at least partially filled pouch from said substantially vertical position to said substantially horizontal position.

2. The method recited in claim 1 further comprising, after step k, the steps of:

(l) introducing additional fluid into said at least partially filled pouch to a level that exceeds a predetermined level defining a overfilled pouch;

(m) determining the weight of said overfilled pouch; and, (n) evacuating excess fluid and remaining air contained in said overfilled pouch to a final predetermined level.

3. The method recited in claim 1 wherein the step of determining said weight of said pouch to be filled further comprises the steps of:

(a) providing a load cell for taring the weight of said pouch and an apparatus for filling said pouch; (b) providing a substantially frictionless mount for said apparatus for filling said pouch; (c) applying an impact force on said cartridge when said cartridge is pivoted from the horizontal to the vertical position, said impact force dislodging entrapped air inside said pouch.

4. The method recited in claim 3 wherein the step of applying an impact force on said cartridge includes the step of positioning a biased mass in the path of motion of said pivoting cartridge.

5. The method recited in claim 3 wherein said step of evacuation includes the step of applying a vacuum to said pouch through said fluid ejection unit.

* * * * *